US005355606A

United States Patent [19]

Origoni

[11] Patent Number: 5,355,606

[45] Date of Patent: Oct. 18, 1994

[54] APPARATUS FOR LOADING BULLETS INTO A CLIP

[76] Inventor: Roberto E. Origoni, 290 Larmier Ave., Oak View, Calif. 93022

[21] Appl. No.: 18,318

[22] Filed: Feb. 16, 1993

[51] Int. Cl.[5] ..... F41A 9/83

[52] U.S. Cl. ..... 42/87

[58] Field of Search ..... 42/50, 87, 90

[56] References Cited

U.S. PATENT DOCUMENTS 4,689,909 9/1987 Howard ..... 42/87

5,249,386 10/1993 Switzer ..... 42/89

FOREIGN PATENT DOCUMENTS 255740 7/1948 Switzerland ..... 42/87

*Primary Examiner*—Stephen C. Bentley

*Attorney, Agent, or Firm*—Jack C. Munro

[57] ABSTRACT

An apparatus for assisting a human in loading ammunition into a clip which takes the form of an elongated housing upon which is mounted a manually pressable rod. The housing is to be mounted in a fixed position on the exterior wall of the clip. Manual pressing of an actuator mounted on the rod will cause the bullets contained within the clip to be moved in a downward direction away from the access opening of the clip so as to facilitate entry of another bullet into the access opening of the clip.

5 Claims, 2 Drawing Sheets

APPARATUS FOR LOADING BULLETS INTO A CLIP

BACKGROUND OF THE INVENTION

1. Field of the Invention

The present invention relates to ammunition loading apparatuses and more particularly to an apparatus which is to be connectable to a clip of ammunition which makes the loading of the ammunition into the clip substantially easier.

2. Description of Prior Art

Ammunition clips have long been used in conjunction with firearms. A clip is a magazine that holds a plurality of rounds (bullets) in a stacked relationship within the housing of the clip. The clip is to be connected to the firearm and during operation of the firearm the bullets are to fired with the firing occurring with the uppermost bullet in the stacked series of bullets. The firearm functions to remove the uppermost bullet to affect the firing of such.

A clip takes form of a hollow housing which has a follower slidably mounted therein. The stacked series of bullets are to be mounted on this follower with the lowest bullet in this stacked series of bullets being in contact with the follower. The follower is normally spring biased toward the access opening of the housing.

The loading operation for the clip usually employs the users thumb and fingers to add one bullet at a time into the stacked series of bullets causing the stacked series of bullets to be moved against the bias of the spring contained within the clip and moving the follower down toward the bottom of the clip until the clip contains a full component of bullets. Generally a full component will be at least nine bullets. It is to be readily apparent that this loading operation requires some amount of manual dexterity. Humans that engage in the sport of discharging firearms may commonly use twenty or more clips in a single sitting. This means that all twenty clips have to be loaded. What occurs is the humans fingers and thumbs become sore and this loading of the bullets into the clips becomes a most undesirable procedure.

There has long been a need for some type of a device to facilitate this loading procedure. Within the prior art there are numerous devices that have been known to assist a human in this loading procedure. Many of these devices connect directly onto the body in the clip in one way or another and cause the bullets to be displaced in a downward direction so that a new bullet can be inserted within the clip. However, in the past, most of devices have been quite complex in construction and inherently relatively expensive. Also, many of the devices just did not work satisfactorily.

SUMMARY OF THE INVENTION

The primary objectives of the present invention is to construct an apparatus to facilitate loading of bullets within a clip which is simple in construction, can be manufactured inexpensively and therefore sold to ultimate consumer at a relatively inexpensive price, quickly attaches and detaches from the clip that is being loaded and can be operated by even the most unskilled individual.

Another objective of the present invention is by utilizing the apparatus of the present invention the hands and fingers of the user do not become sore regardless of how many clips are loaded with this loading procedure being affected quickly and easily.

The apparatus of the present invention comprises an elongated housing that has a lower mount and an upper mount. Both the lower mount and the upper mount is to matingly connect with the side wall of a clip with the upper mount being located against the necked down area around the access opening of the clip and the lower mount being located nearer the bottom of the clip than the access opening. The elongated housing includes an internal through opening within which is mounted a rod. This rod is spring biased in an upper or outward position. This rod is longitudinally movable relative to the elongated housing. The upper end of the rod is attached to an actuator which is to be manually depressed which causes an actuating end to be pressed against the uppermost bullet in the stacked series of bullets mounted within the clip. This pressing movement will cause the stacked series of bullets to be deflected in a downward direction providing enough clearance for insertion of another bullet at the upper end of the clip with this bullet now become the new uppermost bullet. The position of the rod on the housing can be adjusted so as to accommodate to slightly different configurations of clips and slightly different thicknesses of bullets.

DETAILED DESCRIPTION OF THE SHOWN EMBODIMENT

Figure 1:
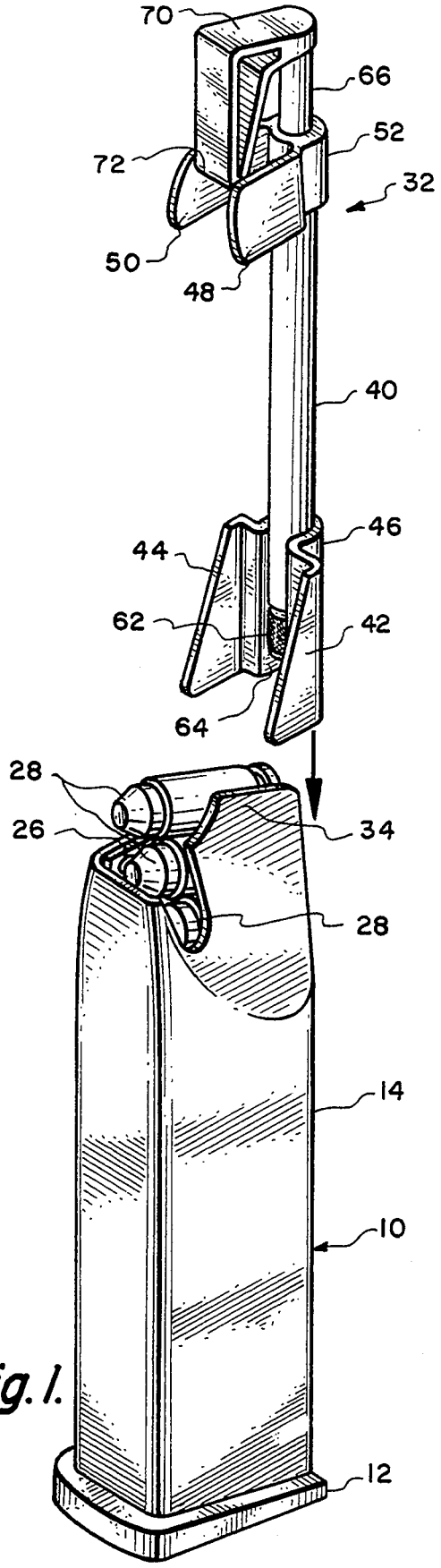
FIG. 1 is an exploded isometric view of a clip and apparatus of the present invention depicting the connecting procedure of the apparatus to the clip.

Referring in particular to the drawings there is shown a conventional ammunition or bullet clip 10 which is elongated and basically rectangular in transverse cross-section. The clip 10 has a bottom 12 and a back sidewall 14. Sidewall 14 extends from bottom 12 to the upper end of the clip 10 which is formed into an access opening 38. In comparison to the width of the internal chamber 16 of the clip 10, the access opening 38 asuumes a necked down configuration which is formed by inwardly flaring of sidewalls 34 and 36. Bullets 28 and 30, which are also referred to as ammunition and rounds, are to be located a stacked relationship within internal chamber 16 with the bottom most round 28 resting on follower 18. Within FIGS. 1, 2 and 4, there are shown three in number of bullets 28. Within FIGS. 5, 6 and 7 there is shown the adding of an additional bullet which is referred to as bullet 30 which will comprise the uppermost bullet in the stacked series of bullets.

The follower 18 is slidably mounted in a close fitting manner within the internal chamber 16. Fixedly mounted to the undersurface of the follower 18 is a mounting block 20. Fixed to the mounting block 20 and the forward wall 21 of the follower 18 is a rod 22. Mounted on rod 22 in a coil is the outer end of a leaf spring 24. The inner end of the leaf spring 24 is fixedly secured by rivet 26 to a sidewall of the elongated housing of the clip 10. It is the function of the spring 24 to exert a bias on the follower 18 tending to locate such directly adjacent the access opening 38. As bullets 28 and 30 are placed within the internal chamber 16, the follower 18 moves against the bias of the spring 24 with the follower 18 asuuming a further spaced position from the access opening 38. The clip 10 will normally hold about twelve rounds of ammunition.

Figures 4, 5, 6, 7:
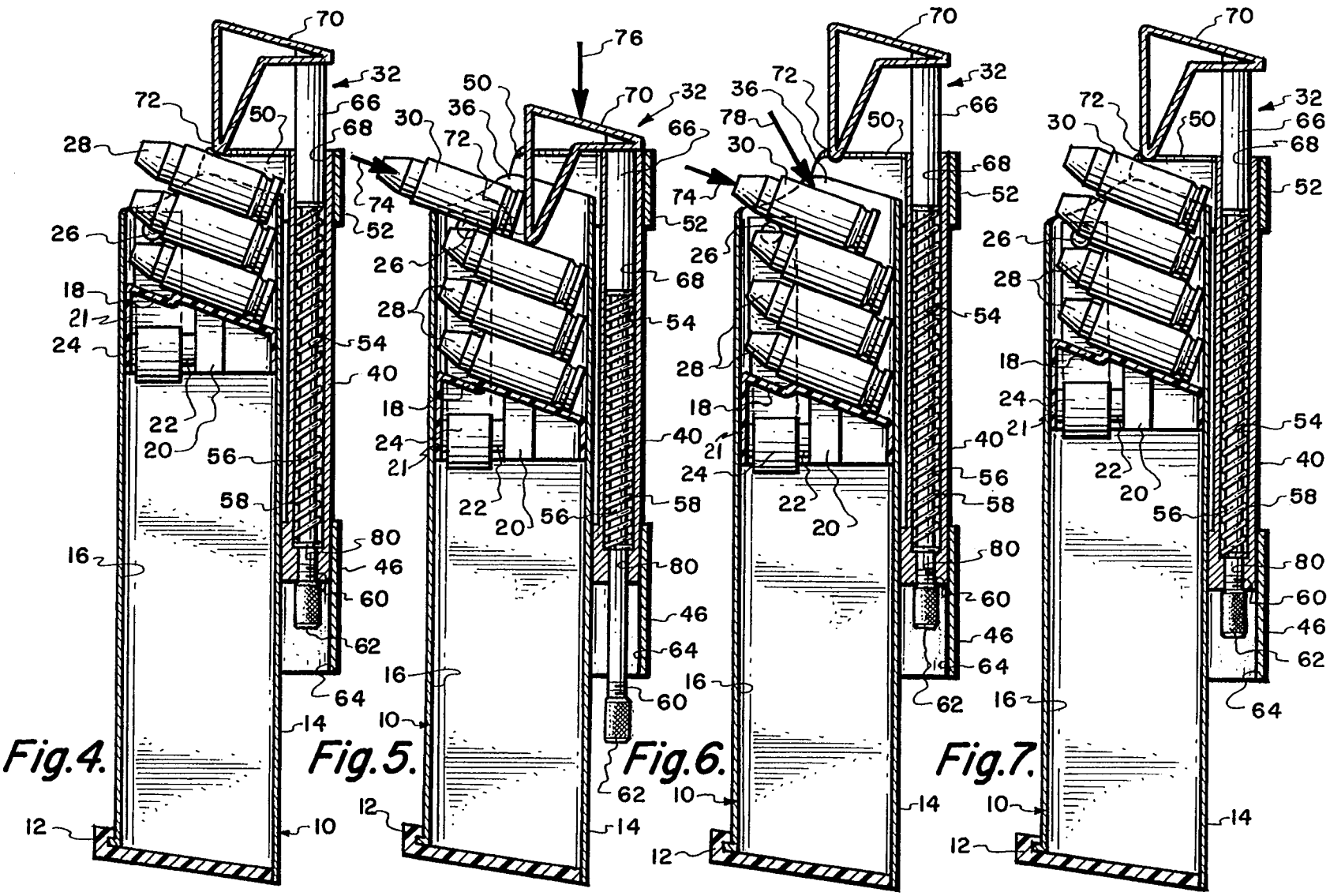
FIG. 4 is a longitudinal, cross-sectional view through the clip and the apparatus of the present invention taken along line 4—4 of FIG. 2 showing the apparatus in an at rest position with three bullets being located within the clip.
FIG. 5 is a view similar to FIG. 4 but showing the apparatus of this invention being operated to locate the three bullets in a downwardly displaced position within the clip providing enough clearance for insertion of a fourth bullet within the clip.
FIG. 6 is a view showing release of the apparatus of the present invention and showing moving of a fourth bullet within the clip to its fully installed position.
FIG. 7 is a view similar to FIG. 6 showing the apparatus in an at rest position and four bullets completely installed.

In order to insert the uppermost round 30 in position, the lowermost rounds 28 are to be moved downwardly a slight distance as shown in FIG. 5. This permits the round 30 to be placed within the access opening 38 to be moved a short distance inwardly in the direction of arrow 74. Once the rear portion of the bullet 30 lies within the confines of the necked down area forming the access opening 38, upward and outward discharge of the bullet 30 is prevented. Therefore, upon continuing the movement represented by arrow 74 and applying downward pressure in the direction of arrow 78, the bullet 30 will then be movable to come into contact with the back sidewall 14. At this time the bullet 30 is now completely installed within the clip 10.

This installing procedure, if performed totally manually without the addition of any tool, is difficult, tedious and actually can cause the fingers and thumbs of the installer to become sore in a very short period of time. To make the job of loading the bullets 28 and 30 within the clip 10, there is to be utilized the tool 32 of this invention.

The tool 32 has an elongated cylindrical shaped housing 40 which terminates at the lower end into a lower mount and at the upper end in an upper mount. The lower mount is formed of a pair of parallel side flanges 42 and 44 which are interconnected by an apex section 46. This apex section 46 if fixedly mounted onto the the housing 40. The distance between the side flanges 42 and 44 is just slightly greater than the width of the clip 10. This is so that when the flanges 42 and 44 are located on opposite sides of the clip 10, lateral movement of the lower end of the tool 32 is prevented. However, longitudinal sliding movement of the lower mount on the clip 10 would be permitted. It is to be understood that the lower mount is mounted at the back sidewall 14.

The upper mount similarly includes a pair of flanges 48 and 50 which are interconnected by an apex section 52. This apex section 52 is also fixedly mounted onto the housing 40. It is to be noted that the flanges 48 and 50 are canted relative to each other so that the upper surface of the flanges 48 and 50 form a narrower opening than the bottom surface of the flanges 48 and 50. This canting of the flanges 48 and 50 is so that flange 48 will be flush against flared end 34 of the clip 10 and flange 50 will rest flush against the flared end 36 of the clip 10. This tapered interconnecting relationship between the flared ends 34 and 36 and their respective flanges 48 and 50 will not only restrain the upper end of the tool 32 laterally but also restrain it longitudinally.

Housing 40 includes an internal through opening 54. At the lower end, this opening 54 assumes a smaller diametered opening 80. Within the opening 54 is located a coil spring 58. Within the confines of the coil spring 58 is conducted a smallered diametered section 56 of a rod. This smaller diametered section 56 is located within a smaller diametered opening 80. Smaller diametered section 56 includes a series of screw threads 60. Threadably mounted on the threads 60 is a nut 62. The nut 62 is located within chamber 64 which is formed by apex 46.

The smaller diametered section 56 connects at its upper end to a larger diametered section 66 of the rod. This section 66 is slidingly mounted within the access opening 68 providing entry into the through opening 54. The outer upper end of the section 66 is fixedly secured to the back end of an actuator which has a manually pressable surface 70 and an actuating end 72. The actuator is formed basically in a right angle configuration.

Figure 2:
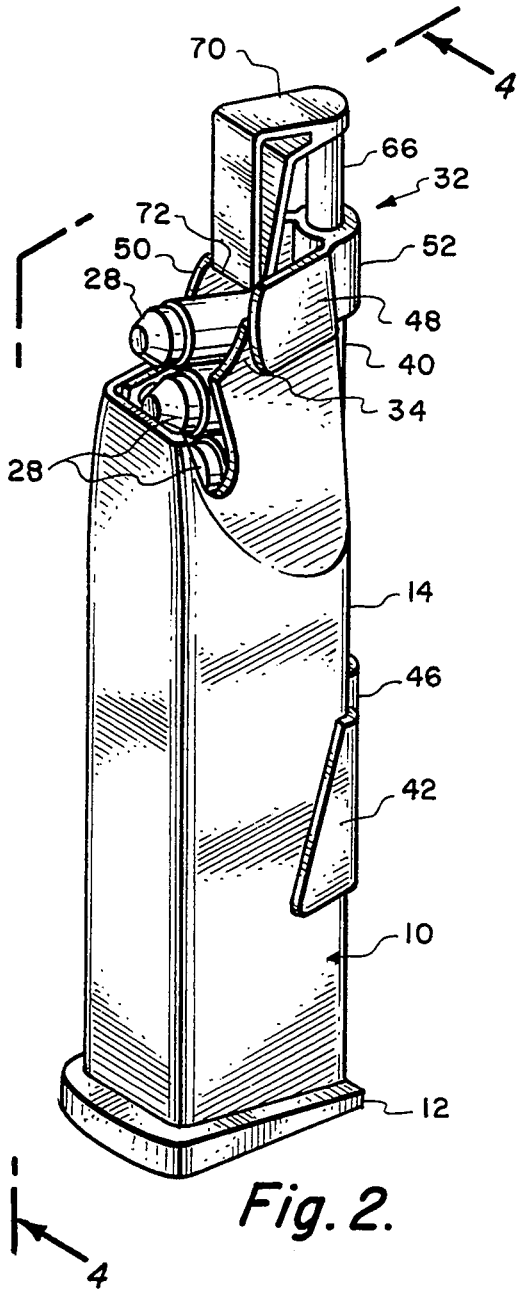
FIG. 2 is an isometric view of the clip and the apparatus of the present invention showing the apparatus being mounted on the clip.
Figure 3:
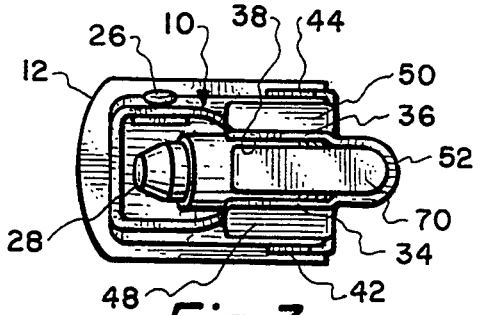
FIG. 3 is a top plan view of the structure shown within FIG. 2.

The operation of the tool 32 of this invention is as follows: The user first places the tool 32 in contact with the housing of the clip 10 as is depicted in FIGS. 1 and 2 of the drawings. The user then grasps the clip 10 with one hand with the users hand being pressed against the housing 40. The user then takes his or her thumb and presses on pressable surface 70 in the direction of arrow 76. This causes the actuating end 72 to press against the uppermost bullet of the series of bullets 28. The user then continues to press on the pressing end 70 until the back end of the actuator comes to rest against the apex section 52. In this particular position the stacked series of the bullets 28 have been displaced in a downward direction the exact distance that is desired.

The user then takes a new bullet 30 and inserts such as previously mentioned in conjunction with the access opening 38 as is shown in FIG. 5. At this time the back end of the bullet 30 is restrained against upward and outward movement by the necked down area defined by inwardly extending flanges 34 and 36. The user then releases the pressure against the actuator which will result in the actuator being moved to an upward displaced position as shown in FIG. 6 by means of the bias of the coil spring 58. This displaces the actuating end 72 from the bullet 30 so that the bullet 30 can then be slid inwardly against the wall 14 as is represented in FIGS. 6 and 7 of the drawings. This now locates the bullet 30 in position.

This procedure is to be repeated for each installation of the new bullet within the clip 10 until the clip is entirely full. When clip 10 is completely full of bullets, the tool 32 is merely removed from the clip 10 and may be reconnected with an empty clip 10 and this bullet installing procedure repeated.

At times, because of a particular configuration of clip 10 or because of the thickness of bullets, it may be desired to adjust the position of the actuating end 72 relative to the uppermost bullet 30. It is desired that the actuating end 72 assume a slightly spaced position relative to the bullet when the actuacting end 72 is in an at rest position as is shown in FIGS. 4 and 7 of the drawings. In order to provide for this adjustment, the nut 62 can be moved on the threaded end 60 in either direction which will correspondingly move the actuating end 72 either lower or higher relative to the bullet 30. It is important that the actuating end 72 always be located between flanges 48 and 50 so that the actuating end 72 will always be located in a position ready to contact the uppermost bullet 30.

What is claimed is:

1. In the combination with a clip for containing a series of bullets in a stacked relationship, said clip having an exterior wall, said clip having a single access opening through which the bullets are to be loaded within said clip, said exterior wall around said access opening being inwardly flared forming a necked down area to hold in position the uppermost bullets of the stacked series of bullets, an apparatus for loading bullets into said clip comprising:

an elongated housing having a lower mount and an upper mount, said lower mount to connect with said exterior wall of said clip, said lower mount being spaced from said access opening, said upper mount to engage with said exterior wall of said clip at said necked down area, said lower mount being restrained laterally on said clip, said upper mount being restrained laterally and longitudinally on said clip;

a rod mounted on said elongated housing and parallel to said exterior wall, said rod being longitudinally movable relative to said elongated housing maintaining its parallel relationship to said elongated housing, said rod and said elongated housing being exteriorly mounted on and in juxtaposition to said clip; and an actuator mounted on said rod directly adjacent said access opening, said actuator having a pressable section for being manually contacted by a human user to move said rod relative to said elongated housing, said actuator having an actuating end for contacting said uppermost bullet within said necked down area, sufficient pressing on said actuator causes said actuating end to press against said uppermost bullet and displace said stacked series of bullets a sufficient distance to permit entry of another bullet into said clip which will then become the uppermost bullet upon manual release of said actuator.

2. The combination as defined in claim 1 wherein:

said clip having a bottom which is located furthest from said access opening, said lower mount being located closer to said bottom than said access opening.

3. In combination with a clip for containing a series of bullets in a stacked relationship, said clip having an exterior wall, said clip having a single access opening through which the bullets are to be loaded within said clip, said exterior wall around said access opening being inwardly flared forming a necked down area to hold in position the uppermost bullet of the stacked series of bullets, an apparatus for loading bullets into said clip comprising;

an elongated housing having a lower mount and an upper mount, said lower mount to connect with said exterior wall of said clip, said lower mount being spaced from said access opening, said upper mount to engage with said exterior wall of said clip at said necked down area, said lower mount being restrained laterally on said clip, said upper mount being restrained laterally and longitudinally on said clip;

a rod mounted on said elongated housing and parallel to said exterior wall, said rod being longitudinally movable relative to said elongated housing maintaining its parallel relationship to said elongated housing;

an actuator mounted on said rod directly adjacent said access opening, said actuator having a pressable section for being manually contacted by a human user to move said rod relative to said elongated housing, said actuator having an actuating end for contacting said uppermost bullet within said necked down area, sufficient pressing on said actuator causes said actuating end to press against said uppermost bullet and displace said stacked series of bullets a sufficient distance to permit entry of another bullet into said clip which will then become the uppermost bullet upon manual release of said actuator;

said clip having a bottom which is located furthest from said access opening, said lower mount being located closer to said bottom than said access opening; and said elongated housing having an internal through opening, said rod being mounted within said internal through opening, a spring mounted within said internal through opening, said spring exerting a continuous bias against said rod tending to locate said actuating end spaced from the uppermost bullet.

4. In the combination with a clip for containing a series of bullets in a stacked relationship, said clip having an exterior wall, said clip having a single access opening through which the bullets are to be loaded within said clip, said exterior wall around said access opening being inwardly flared forming a necked down area to hold in position the uppermost bullets of the stacked series of bullets, an apparatus for loading bullets into said clip comprising:

an elongated housing having a lower mount and an upper mount, said lower mount to connect with said exterior wall of said clip, said lower mount being spaced from said access opening, said upper mount to engage with said exterior wall of said clip at said necked down area, said lower mount being restrained laterally on said clip, said upper mount being restrained laterally and longitudinally on said clip;

a rod mounted on said elongated housing and parallel to said exterior wall, said rod being longitudinally movable relative to said elongated housing maintaining its parallel relationship to said elongated housing, said rod and said elongated housing being exteriorly mounted on and in juxtaposition to said clip;

an actuator mounted on said rod directly adjacent said access opening, said actuator having a pressable section for being manually contacted by a human user to move said rod relative to said elongated housing, said actuator having an actuating end for contacting said uppermost bullet within said necked down area, sufficient pressing on said actuator causes said actuating end to press against said uppermost bullet and displace said stacked series of bullets a sufficient distance to permit entry of another bullet into said clip which will then become the uppermost bullet upon manual release of said actuator;

said clip having a bottom which is located furthest from said access opening, said lower mount being located closer to said bottom than said access opening;

said elongated housing having an internal through opening, said rod being mounted within said internal through opening, a spring mounted within said internal through opening, said spring exerting a continuous bias against said rod tending to locate said actuating end spaced from the uppermost bullet; and adjustment means connected to said rod, operating of said adjustment means varies the position of said rod relative to said elongated housing, whereby the at rest spacing of said actuating end relative to the uppermost bullet can be varied depending upon the size of said bullets and the configuration of said exterior wall of said clip.

5. In the combination with a clip for containing a series of bullets in a stacked relationship, said clip having an exterior wall, said clip having a single access opening through which the bullets are to be loaded within said clip, said exterior wall around said access opening being inwardly flared forming a necked down area to hold in position the uppermost bullets of the stacked series of bullets, an apparatus for loading bullets into said clip comprising:

an elongated housing having a lower mount and an upper mount, said lower mount to connect with said exterior wall of said clip, said lower mount being spaced from said access opening, said upper mount to engage with said exterior wall of said clip at said necked down area, said lower mount being restrained laterally on said clip, said upper mount being restrained laterally and longitudinally on said clip;

a rod mounted on said elongated housing and parallel to said exterior wall, said rod being longitudinally movable relative to said elongated housing maintaining its parallel relationship to said elongated housing, said rod and said elongated housing being exteriorly mounted on and in juxtaposition to said clip;

an actuator mounted on said rod directly adjacent said access opening, said actuator having a pressable section for being manually contacted by a human user to move said rod relative to said elongated housing, said actuator having an actuating end for contacting said uppermost bullet within said necked down area, sufficient pressing on said actuator causes said actuating end to press against said uppermost bullet and displace said stacked series of bullets a sufficient distance to permit entry of another bullet into said clip which will then become the uppermost bullet upon manual release of said actuator; and adjustment means connected to said rod, operating of said adjustment means varies the position of said rod relative to said elongated housing, whereby the at rest spacing of said actuating end relative to the uppermost bullet can be varied depending upon the size of said bullets and the configuration of said exterior wall of said clip.

* * * * *